US006464006B2

(12) United States Patent
Womble

(10) Patent No.: US 6,464,006 B2
(45) Date of Patent: Oct. 15, 2002

(54) SINGLE TRIP, MULTIPLE ZONE ISOLATION, WELL FRACTURING SYSTEM

(75) Inventor: Allen W. Womble, Maurice, LA (US)

(73) Assignee: Baker Hughes Incorporated, Houston, TX (US)

( * ) Notice: Subject to any disclaimer, the term of this patent is extended or adjusted under 35 U.S.C. 154(b) by 38 days.

(21) Appl. No.: 09/793,244

(22) Filed: Feb. 26, 2001

(65) Prior Publication Data

US 2002/0117301 A1 Aug. 29, 2002

(51) Int. Cl.[7] ..... E21B 43/02

(52) U.S. Cl. ..... 166/276; 166/51; 166/278; 166/205; 166/320; 166/334.4

(58) Field of Search ..... 166/51, 276, 278, 166/205, 320, 334.4

(56) References Cited

U.S. PATENT DOCUMENTS

| | | | | |
|---|---|---|---|---|
| 4,270,608 A | | 6/1981 | Hendrickson et al. | 166/278 |
| 4,273,190 A | | 6/1981 | Baker et al. | 166/278 |
| 4,401,158 A | | 8/1983 | Spencer et al. | 166/51 |
| 4,428,431 A | | 1/1984 | Landry et al. | 166/298 |
| 4,540,051 A | | 9/1985 | Schmuck et al. | 166/278 |
| 4,541,486 A | | 9/1985 | Wetzel et al. | 166/297 |
| 5,076,365 A | * | 12/1991 | Jenkins | |
| 5,174,379 A | | 12/1992 | Whiteley et al. | 166/278 |
| 5,443,117 A | * | 8/1995 | Ross | 166/51 |
| 5,577,559 A | * | 11/1996 | Voll et al. | 166/278 |
| 5,597,040 A | * | 1/1997 | Stout et al. | 166/51 |
| 5,845,712 A | * | 12/1998 | Griffith, Jr. | 166/278 |
| 5,921,318 A | * | 7/1999 | Ross | 166/250.17 |
| 6,176,307 B1 | * | 1/2001 | Danos et al. | |
| 6,343,651 B1 | * | 2/2002 | Bixenman | |

* cited by examiner

*Primary Examiner*—Roger Schoeppel
(74) *Attorney, Agent, or Firm*—Madan, Mossman & Sriram, P.C.

(57) ABSTRACT

An apparatus and operating method allows the completion of multiple production zones in a single wellbore with a single downhole trip. The work string descends with a coaxially combined completion string and service string. The completion string is set into a previously set basement packer. The completion string includes a series of production screens, transverse flow orifices, isolation packers and collet indicating couplings, all prepositioned along the completion string length relative to the basement packer set location. The production sleeves and transverse flow orifices are selectively closed by axially sliding sleeves. The service string includes a crossover flow tool, a SMART collet tool, sleeve shifting tools and sleeve closing tools. With all orifice and screen closure sleeves closed, the procedure proceeds from the lowermost production zone to open the closure sleeves respective to the flow orifice and screens dedicated to a respective production zone. As each zone is completed, the respective flow orifices and screens are closed and the next higher zone orifices and screens are opened.

11 Claims, 9 Drawing Sheets

SINGLE TRIP, MULTIPLE ZONE ISOLATION, WELL FRACTURING SYSTEM

BACKGROUND OF THE INVENTION

1. Field of the Invention

The present invention relates to a method and apparatus for completion of a petroleum production well. In particular, the invention relates to a method and apparatus for fracturing and gravel packing multiple production zones in a single downhole trip.

2. Description of the Related Art

Petroleum production from a well bore is often enhanced by a process that is characterized as "fracturing". According to the general principles of fracturing, the fracturing process induces increased fluid flow from the wellbore production face by generating additional cracks and fissures into the zone radiating from the well bore wall. The objective of such additional cracks and fissures is an increase in the production face area. This increased production area facilitates migration of a greater volume of petroleum fluid into the well production flow stream than would otherwise occur from the simple cylinder wall penetration area provided by the original borehole.

Among the known methods of creating or enlarging such cracks and fissures into a fluid production zone is that of forcing liquid into the formation under extremely high pressure. Mixed with the high pressure fracturing liquid are particulates such as coarse sand or fine gravel known as propants. These propants have the function holding open and maintaining the permeability of zone fractures.

Often entrained in the natural flow of petroleum fluid from the geologic formations of origin, e.g. production zones, are considerable quantities of fine sand and other small particulates. If permitted, these particulates will accumulate in the production flow tubing and the region of the borehole where the production flow enters the production tubing. Continued accumulation eventually restricts and terminates production flow.

One well known method of controlling a flow restricting accumulation of such fine particulates is placement of gravel around the exterior of a slotted, perforated, or other similarly formed liner or screen to filter out the unwanted sand. This practice is generally characterized as gravel packing. According to one method of practicing the method, a gravel filter is deposited in the annular space between the production screen and the casing in the form of a fluid slurry. The slurry carrier fluid passes through the screen into the production tubing and returned to the surface. The gravel constituent of the slurry is separated by the screen and deposited in the wellbore, liner or casing around the screen.

Typically, a screen or perforated casing liner is positioned within a borehole casing. The casing is perforated adjacent to the production formation. Packers are set in the annulus between the borehole casing and the casing liner, for example, above and below the production zone. A string of tubing is run inside of the liner assembly in the area of the liner screen. The gravel slurry is pumped from the surface down the internal bore of the tubing string and through a crossover tool out into the packer isolated annulus. From the isolated annulus, the slurry carrier fluid passes through the screen into the liner bore thereby depositing the gravel in the isolated annulus around the screen. From the liner bore, the fluid carrier reenters the crossover tool for conduit past a seal between the tubing exterior and the liner bore. Above the upper packer respective to the isolated annulus, the fluid return flow path is routed into the annulus surrounding the tubing which may be the liner and/or the casing.

After placement of the filtration gravel is completed, the crossover tool is repositioned and the circulation of carrier fluid is reversed to flush residual gravel from the tubing string bore.

In many petroleum producing fields, valuable fluids are found in several strata at respective depths. Often, it is desired to produce the fluids of these several depths into a single production tube. Execution of this desire consequently requires that each of the vertically separate production zones is separately gravel packed.

Gravel packing multiple production zones along the same wellbore traditionally has required that the operating string be lowered into and withdrawn from the wellbore for each production zone. The cycle of entering and withdrawing a tool from a borehole is characterized in the earthboring arts as a "trip". The outer string, containing the packing screens, is assembled from the bottom up in a step by step process. The operator must withdraw the operating string after each zone completion in order to add components to the outer string that are necessary to complete the next higher production zone. This also renders it impossible to pack a zone below a previously packed upper zone. In some instances, this is due to an inability to place the operating string back in the desired location due to restrictions placed in the outer string after packing a zone. In other cases, it is due to an inability to relocate the desired zone and to position the crossover tool ports with sufficient precision.

A prior art gravel packing procedure for multiple production zones may include an outer completion string having a combined slip and production packer for supporting the completion string within the cased well. Disposed below the production packer is an upper closing sleeve and an upper zone screen. An isolation packer is disposed below the upper zone screen and a lower closing sleeve. A lower zone screen is disposed below the isolation packer. A first sealing bore surface is disposed between the production packer and the upper closing sleeve. A second sealing bore surface is disposed between the upper closing sleeve and the upper zone screen. A third sealing bore surface is disposed between the upper zone screen and an isolation packer. A fourth sealing bore surface is disposed at the lower zone screen. A sump or basement packer is disposed below the lower zone screen around a lower seal assembly. In the case of an open hole, inflatable packers would be used in place of the basement packer and isolation packers.

A surface manipulated inner service tool is lowered into a well coaxially within the completion string. The inner service tool may include a plurality of bonded outer seal rings around the outside perimeter of an outer tube wall. Within the outer tube is an inner tube. An annular conduit is thereby formed between the two concentric tubes. The center tube and seal units form an annulus extending from upper ports in the uppermost seal unit to the lower crossover ports extending through the outer conduit formed by the seal units and the center tube. An additional length of seal units extends from the crossover ports downwardly for several feet followed by an extension and an additional set of seal units to a ported sub and lower seal assembly at its lower end.

For the function of opening and closing the closing sleeves, a prior art service tool might include two shifting tools, one above the crossover tool and one below. A single shifting tool may be used but it must be located very close to the gravel pack ports so that the shifting tool can be raised a very short distance, close the closing sleeve, and still have the gravel pack ports within the short distance range.

An upper ball check is provided at the lower terminal end of the center tube to prevent downward flow through the flowbore of the center tube. A lower check valve is provided in the conduit of the seal units to prevent the downward flow of fluids in the annulus and into the flowbore formed by those seal units disposed below the crossover ports. Another ball check valve is provided at the lower terminal end of the seal units.

In operation, the basement packer is lowered into the well and set by a wire line at a predetermined location in the well below the zones to be produced. The completion string is then assembled at the surface starting from the bottom up until the completion string is completely assembled and suspended in the well up to the packer at the surface. The production screens are located in the completion string relative to the casing perforations and the basement packer. The inner service tool is then assembled and lowered into the outer completion string. The service tool includes one or more shifting tools, depending upon the number of production zones to be produced, for opening and closing the closing sleeves, When the service tool is lowered into the completion string, the shifting tool opens all of the closing sleeves in the completion string. Therefore, it does not matter whether the closing sleeves were initially in the open or closed position since the shifting tools will move them all to the open position as they pass downwardly through the completion string. Subsequently, these sleeves may be moved to the closed position to set the isolation packer depending on the operational type of packer. The packer assembly and setting tool are then attached to the upper ends of the service tool and completion string and the entire assembly lowered into the well on a work string onto the basement packer.

In gravel packing the lower production zone, the setting tool is disconnected from the completion string and is raised such that the set of upper seals no longer engage the first bore seal of the production packer. At that time, the seals on the upper seal units engage the first, third and fourth bore seals and the crossover ports are adjacent the lower closing sleeve which is open. In order to set the isolation packer, the lower closing sleeve must be closed. To do so, the shifting tool in the service string is utilized so that the annulus between the closing sleeve and the outside of the service tool may be pressurized to set the isolation packer.

Next, gravel slurry is pumped down the flowbore of the work string and center tube. The ball valve directs the gravel through the crossover ports and through the open closing sleeve into the lower annulus. The gravel accumulates in the lower annulus adjacent the sump packer with the return flowing through the lower zone screen and ported sub. The return flow continues up the flowbore of the lower seal units and through the lower ball valve. The return flow then passes through the bypass apertures around the crossover ports and up the annulus. Thereafter, the return flows out through the upper ported sub and up the upper annulus formed by the work string and outer casing.

Upon completing the gravel pack of the lower production zone, fluids are reverse circulated d own to the crossover ports to flush residual fluids remaining in the flow bores. Fluid is then pumped down the annulus between the work string and casing, through the upper ported sub at the upper end of the seal units, down the annulus and through the bypass apertures around the crossover ports. The lower ball check prevents the fluid from passing down into the flowbore of the lower seal units and directs the flow through upper ball check and flowbore to the surface.

In gravel packing an upper production zone, the service tool is raised such that the crossover ports are adjacent the upper closing sleeve. Also, the seals on the seal units engage the first, second, and fourth seal bores. Circulation and reverse circulation occurs substantially as previously described with respect to the lower production zone.

A disadvantage of the prior art as described above is that the prior art method and apparatus does not permit performing the gravel pack in a weight-down position which is preferred in the industry. The work string is made up of steel tubing which will contract and expand in the well, particularly when the work string is several thousand feet long. At such lengths, the steel stretches causing the lowermost end of the work string to move several feet within the well. This is particularly a problem in gravel packing operations when it is necessary to position the gravel pack ports accurately across from the closing sleeves.

It is also advantageous to perform other operation, such as hydraulic fracturing, in a down weight position. The work string extending from the top of the service tool to surface has substantial movement during a fracturing or gravel packing operation. The movement of the work string is even more exaggerated than during a gravel pack operation due to the thermal effects caused by the cool fracturing fluid being pumped down through the work string at a very high rate. This tends to cause shrinkage in the work string Further, the work string tends to balloon due to the increased pressure within the work string which also causes the work string to shrink. These combined affects tend to shorten the work string substantially during the operation.

Although a weight indicator is used at the surface to determine the amount of weight hanging off the crown block, the fact that the weight appears to be staying the same does not provide an indication as to whether the length of the work string is changing at its lower end. If the work string shrinks several feet, the gravel pack ports may be raised a distance so as to cause the gravel pack ports to the moved up into the packer seal bore and prematurely end the operation.

Another problem during the fracturing or gravel packing operation is that the pumping of the fluid through the work string at a very high rate causes a vibration in the work string thereby causing it to move up and down. With a very long work string, this reciprocal motion may get very large causing it to bounce up and down within the well such that it may act like a spring.

SUMMARY OF THE INVENTION

The present invention provides an apparatus and method of manipulating the apparatus for sequentially fracturing and gravel packing several production zones at respective depths along a cased borehole. Characteristically, the invention provides for the complete and selective isolation of each production zone. Moreover, the invention permits the well completion operation to be accomplished in a single "trip" cycle into the well.

One object of the present invention is to have the capability of gravel packing multiple zones in a multiple zone completion string with a single trip into the well of the service tool and also have the ability to set weight-down on the completion string during the treatment of the production zones Initially, the raw borehole of a well is lined with a steel casing pipe. Next, the casing pipe is perforated at one or more locations adjacent to respective production zones. A basement packer is thereafter set by wireline below the lowermost production zone. A completion string is assembled with production screens positioned along the completion string length, relative to the basement packer location, to align with each production zone. Each screen may be selectively opened and closed by means of an axially sliding sleeve. Annulus packers are placed in the completion string above and below the perforated casing sector respective to each production zone. Also in the completion string respective to each production zone is a fluid transfer orifice that may be selectively opened and closed by means of an axially sliding sleeve. Finally, each production zone segment of the completion string includes at least one appropriately positioned indicating coupling for manipulating a "SMART" collet in a cooperative service string.

As the assembled completion string hangs from the rig table down into the casing mouth, the service string is assembled coaxially into the completion string. At its lower end, the service string includes, in series, a lower shifting tool, the SMART collet and an upper shifting tool. Above the collet and shifting tools is a cross-flow section. A stand of wash pipe spaces the cross-flow section below the setting tool. The setting tool joins the service string to the work string (drill string) in a manner not subject to downhole disassembly. However, the setting tool also joins the service string to the completion string but in a manner that allows the service string to be disconnected from the completion string by surface manipulation such as rotation.

The completion assembly is lowered into the well and seated onto the basement packer joint. The drill string is then rotated to release the service string from the completion string to permit axial repositioning of the service string relative to the completion string.

Starting from the lowermost production zone and progressing upwardly, the service string is raised to align the cross-over flow port with the first isolation packer. When aligned, the drill string flow bore is pressurized with working fluid to set the first isolation packer against the casing. Next, the closure sleeves respective to the fluid transfer orifice and production screen are opened and the service string aligned to transfer fracturing fluid into the zone isolated annulus between the casing and the outside surface of the completion string. The fracturing fluid initially begins with a substantially "pure" fluid and concludes with gravel particles entrained in the fluid.

The isolation packers respective to each production zone are set independently of other packers or tools. When the gravel packing procedure for each production zone is completed, the service string is lifted and realigned in a weight-down procedure by means of the smart collet. Such resetting of the service string directs a reverse circulation of "pure" fluid from the casing annulus into the service string flow bore-to flush the flow bore of residual gravel slurry.

Following the reverse flow flushing, the closing sleeves respective to the fluid transfer orifices and production screen are closed and the service string lifted to accommodate the next higher production zone where the procedure is repeated.

Sequentially, each production zone is fractured, gravel packed and returned to pressure isolation. Consequently, each zone may be treated at a pressure that is appropriate for that particular production zone. Moreover, each zone may thereafter be selectively produced.

BRIEF DESCRIPTION OF THE DRAWINGS

For a thorough understanding of the present invention, reference is made to the following detailed description of the preferred embodiments, taken in conjunction with the accompanying drawings in which like elements have been given like reference characters throughout the several figures of the drawings.

DESCRIPTION OF THE PREFERRED EMBODIMENTS

Description of Apparatus

Figure 1A:
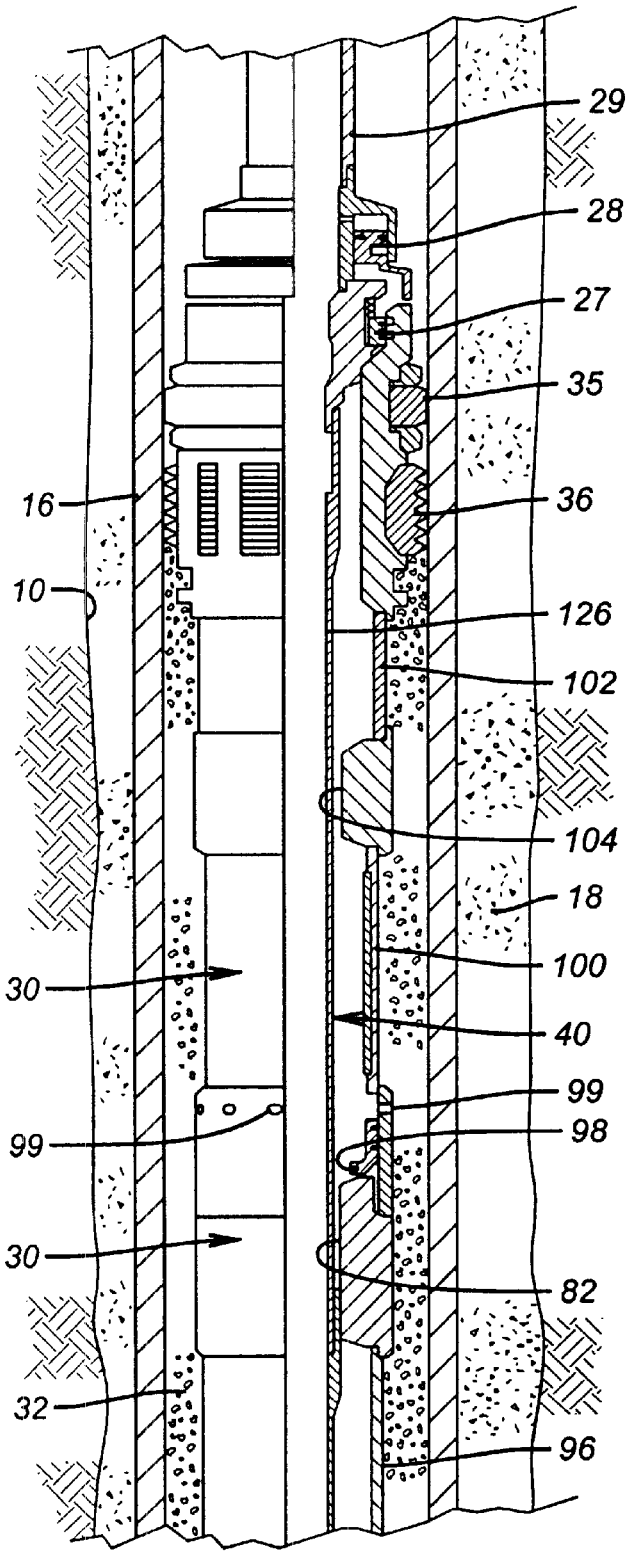
FIGS. 1A through 1C are partial wellbore sections through two petroleum production zones and including portions of the service string within sectioned portions of casing pipe and completion string.
Figure 1B:
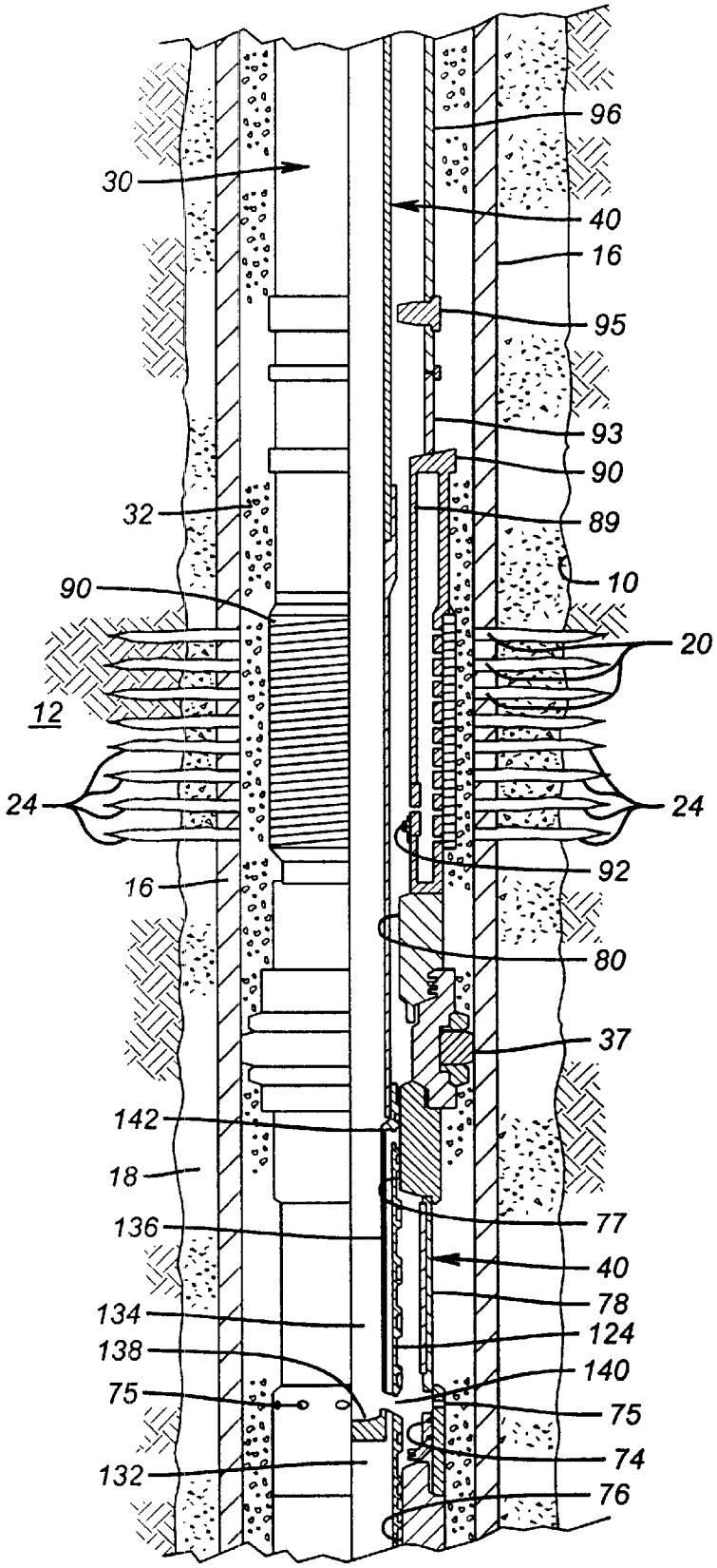
Figure 1C:
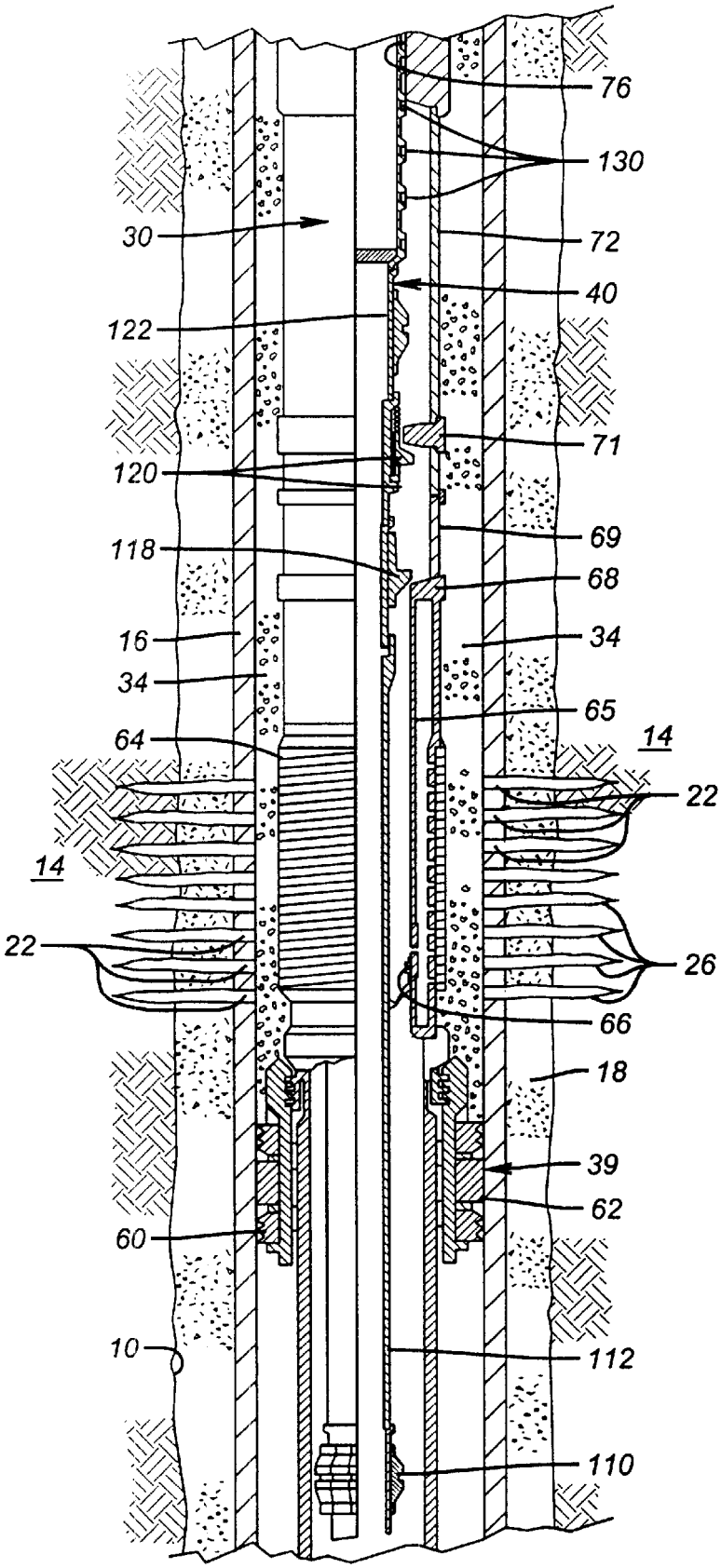
Figure 2A:
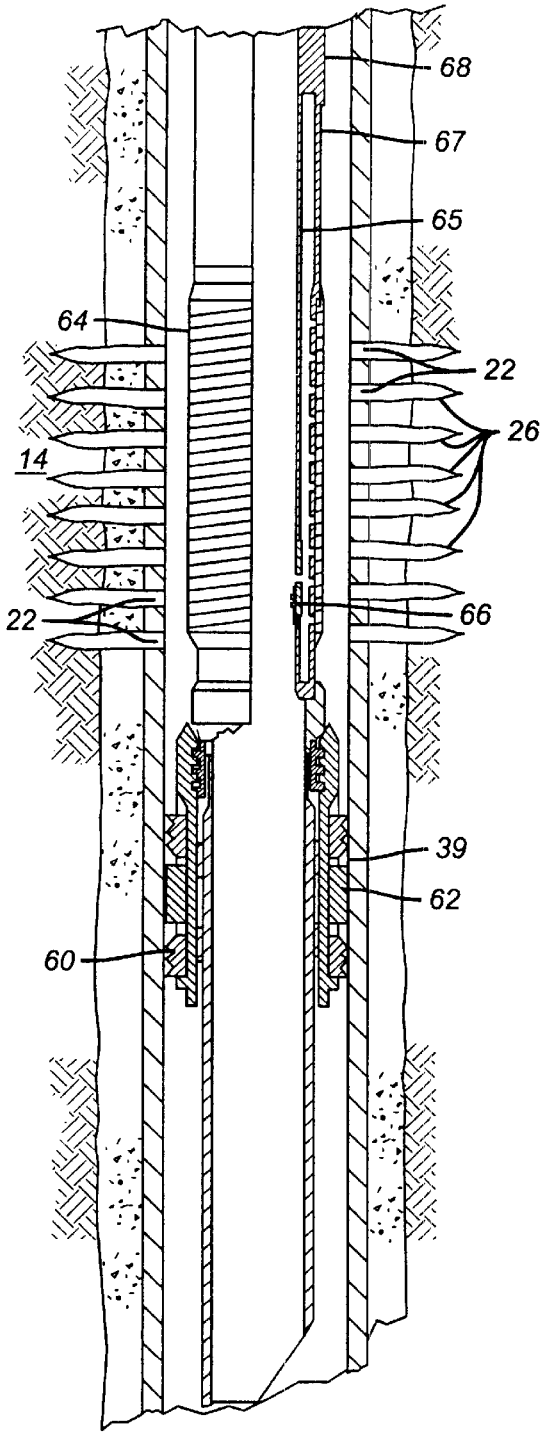
FIGS. 2*a* through 2*d* are axial sections of the present invention completion string.
Figure 2B:
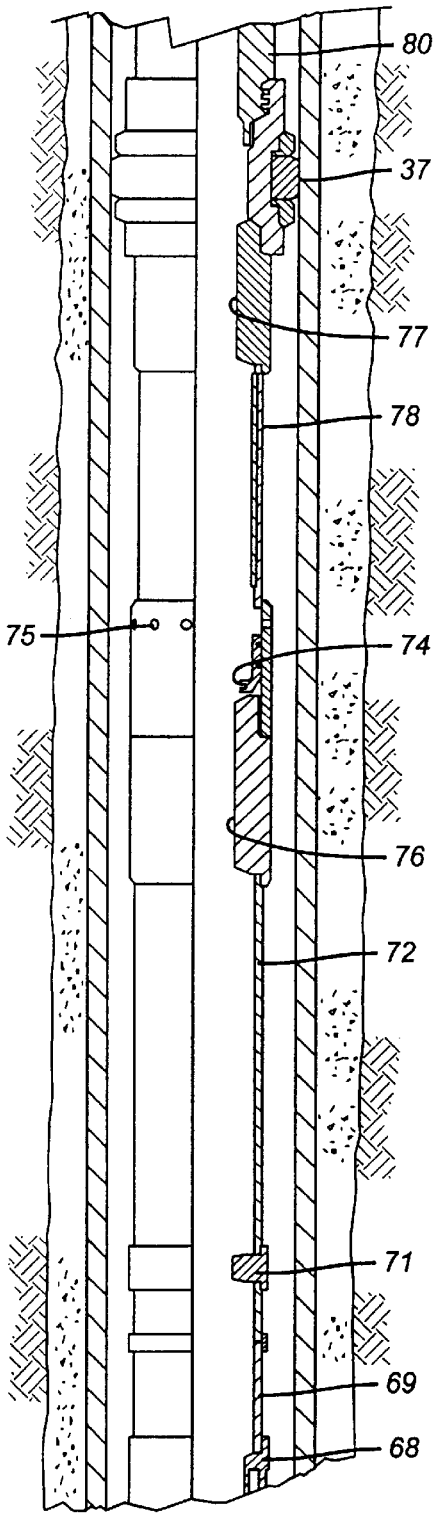
Figure 2C:
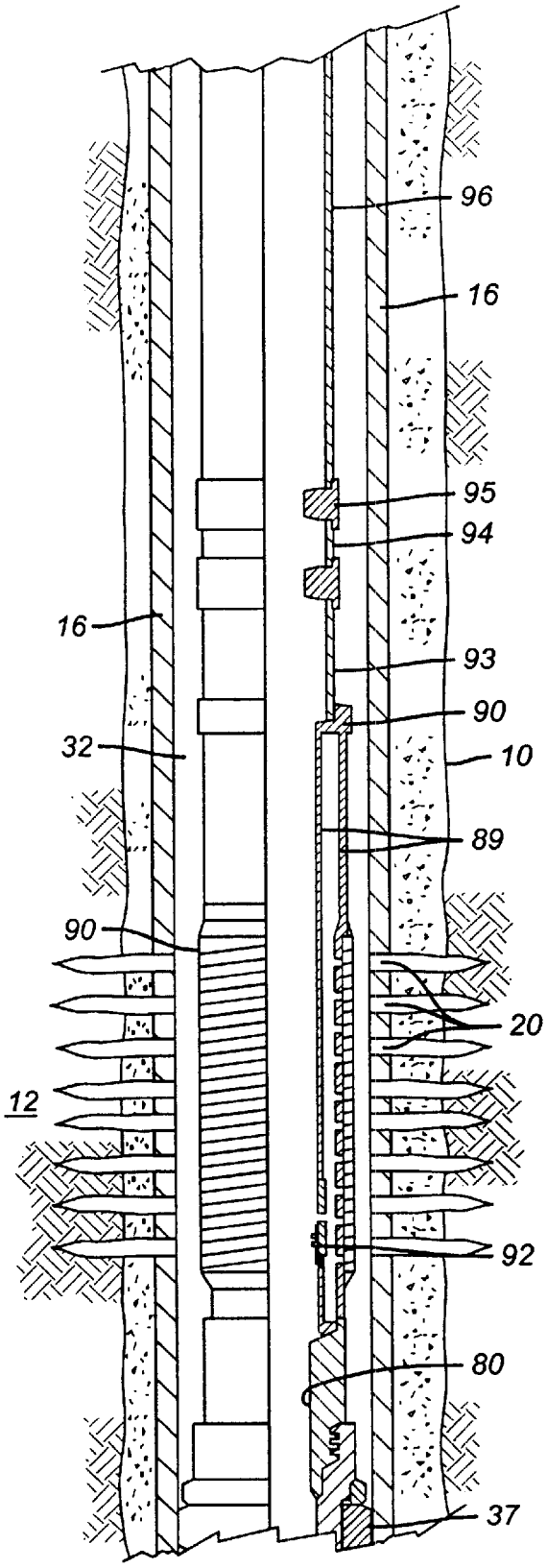
Figure 2D:
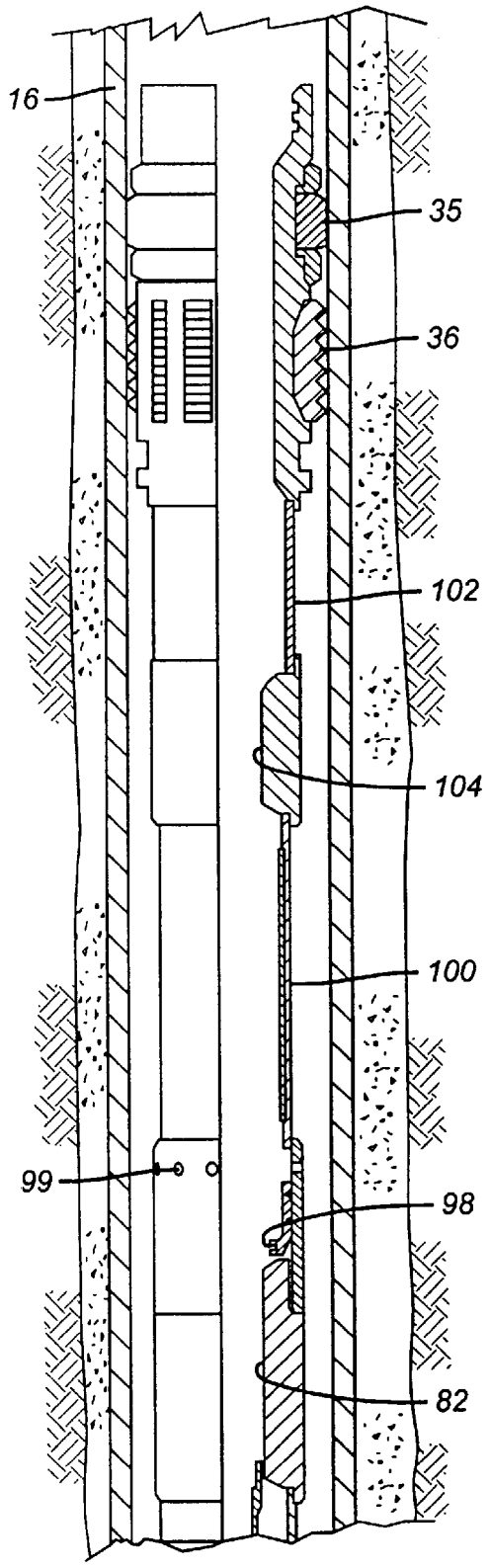

Referring to FIGS. 1A through 1C, the walls 10 of an earthen borehole are drilled sequentially through a plurality of fluid production zones represented by zones 12 and 14. The production fluid is generally perceived as petroleum, i.e. oil or natural gas. However, the invention is not limited to those fluids and may encompass the production of water. Although illustrated here in the traditional vertical sequence, those of ordinary skill will recognize that the production zone sequence may be horizontal. Within the borehole 10, casing pipe 16 may be sealed and secured by cement 18 pumped into the annulus between the wellbore walls and the casing pipe exterior. After cement setting, the casing and surrounding cement is perforated by apertures 20 and 22 opposite of the respective production zones. Completion of the well will include formation fractures 24 and 26 as facilitated by the present invention.

A completion string 30, as is illustrated independently by FIGS. 2, is located within the perforated casing 16 by a basement packer 39 having slips 60 and sealing elements 62. Setting the basement packer 39 is usually a separate, wireline executed, procedure. The slips 60 secure the completion string to the casing 10 whereas the sealing elements 62 seal an annular separation space. The annulus generally continues between the casing 10 and the completion string 30. The packer 39 divides this annular space between space above the packer and space below the packer. The completion string sockets into the basement packer. For the presently described example, the completion string 30 is designed for two production zones. One production zone is above the intermediate packer 37 and the other production zone is below the intermediate packer 37.

Within the lower production section of the completion string 30, above the packer 39 and preferably proximate therewith, is a production screen 64. It is also preferable for the screen 64 to be positioned reasonably close to the lower formation production zone 14 and in alignment with the lower casing perforations 22.

At a selected distance above the screen 64, as determined by the assembly of the service string 40, is an indicating coupling 71. A lower extension 72 sets the spacing distance for an orifice 75 closure sleeve 74 above the indicating couplings. Near the orifice 75 is a cylindrical sealing surface 76 along the internal bore of the completion string 30. This sealing surface also cooperates with corresponding seal glands on the service string 40. Another such cylindrical bore seal 77 is positioned above the closure sleeve 74 at a prescribed distance. An upper liner extension 78 separates the upper sealing bore 77 from the sealing bore surface 76.

The upper production section of the completion string 30, above the intermediate isolation packer 37, includes a lower sealing bore surface 80 positioned above the intermediate packer 37. Above the sealing bore 80 is an upper production screen 90. As with the lower production section, the upper production section has an indicating coupling 95. A lower extension 96 respective to the upper production section spaces the location of the upper bore seal 82 from the upper indicating coupling 95. The closure for the discharge orifice 99 is located relative to the upper bore seal 82. The upper extension pipe 100 spaces the location of the cross-over bore seal 104 from the upper bore seal 82.

Referring again to FIG. 1A, the service string 40 is initially but temporarily secured by an upper end adapter element 27 in coaxial assembly with the completion string 30. The adapter element 27 also secures the service string 40 to the distal end of a drill string 29. The drill string 29 extends down from the well surface. It is supported at the well surface by a rig block in a manner not illustrated but well known to the art. From the surface, the coaxial assembly of service string 40 and completion string 30 is lowered at the end of the drill string 29 through the well bore into stab assembly with the basement packer 39. The basement packer 39 was previously set at the desired perforation depth position by wireline manipulation, for example, relative to the casing perforation sections 20 and 22. Here, the slips 36 of the upper packer 35 are set by packer setting tool 28 to secure the required completion string 30 location. With the completion string 30 secure, the drill string 29 may be manipulated to release the adapter element 27 from the completion string 30.

Figure 3A:
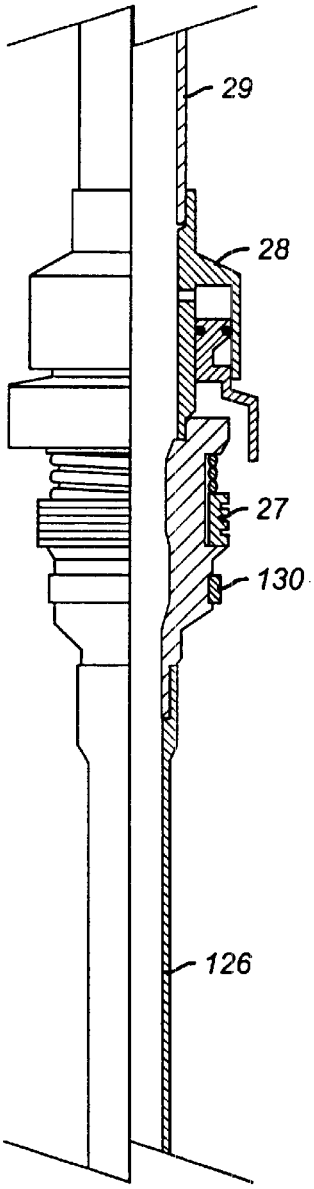
FIGS. 3*a* and 3*b* are axial quarter sections of the present invention service string.
Figure 3B:
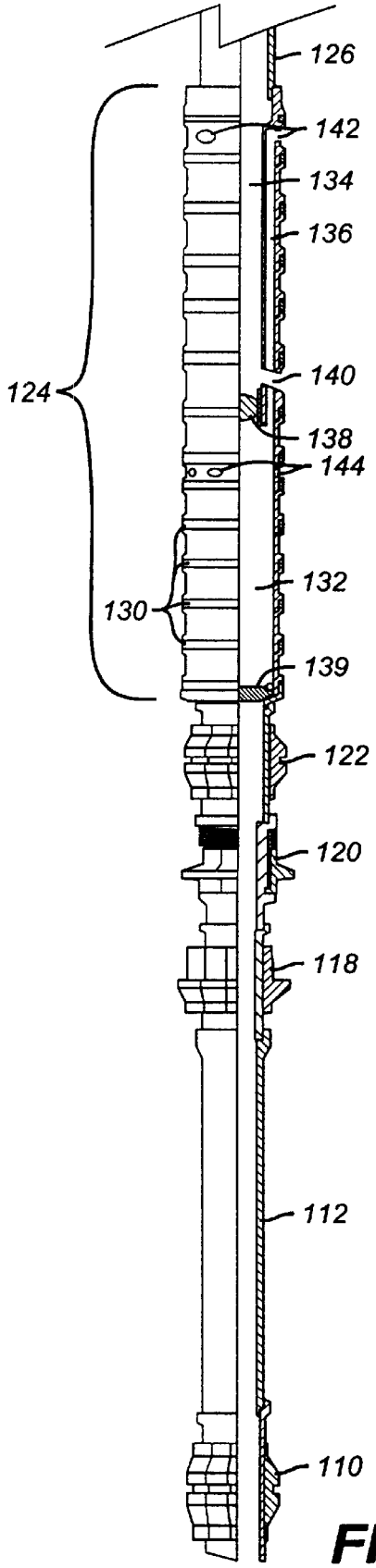

Referring next to FIGS. 3*a* and 3*b* and the service string 40 in particular, a screen sleeve shifting tool 110 is placed at or near the downhole end of the service string. A sub 112 spaces the location of an indicating collet 118 from the shifting tool 110. Next above the indicating collet is a "SMART" collet 120 and fracture sleeve shifting tool 122. Above the fracture sleeve shifting tool is a crossover flow sub 124 having a plurality of bonded ring seals 130.

The crossover flow sub 124 essentially comprises an external flow section 132, a concentric internal flow section 134 and an annular flow section 136. At the lower end of the internal flow section is a flow pipe closing seat 138. Fracture flow ports 140 connect the internal flow section 134 with the pipe exterior above the closing seat 138. Return flow ports 142 connect the annular flow section 136 with the pipe exterior.

A stand of wash pipe 126 connects the cross flow section 124 to the adapter element 27 and provides a continuous section of pipe therebetween having an appropriate length.

The SMART collet 120 is a mechanism in the service string 40 that cooperates with the indicating couplings 70 and 95 in the completion string 30 to positively position the service string 40 at a precise position along the length of the completion string in a weight-down procedure.

The SMART collet mechanism, illustrated schematically herein by FIGS. 6 through 11, is described expansively by the specification of U.S. patent application Ser. No. 09/550,439, now U.S. Pat. No. 6,382,319. In brief, however, the indicating couplings are internal segments of the completion string 30 pipe bore having a reduced inside diameter. An abrupt discontinuity at the bore diameter reduction serves as a ledge or shoulder 42 upon which a corresponding service string shoulder 50 may be abutted as a compressive support surface. The service string shoulder 50 is an element of the SMART collet 120 and more particularly is a profile projection from a plurality of collet fingers 52. The fingers are radially resilient and may be selectively collapsed to permit the collet shoulder 50 to pass the indicator coupling shoulder 42. Alternatively, the collet finger flexure may be blocked by a mandrel upset profile 53 to prevent radial collapse of the fingers 52 and thereby allow the service string 40 weight to be supported by the compression between the coupling shoulder 42 and the SMART collet shoulder 50. Analogously, the mechanism exploits the principles used to construct a retractable point writing pen.

Figure 6:
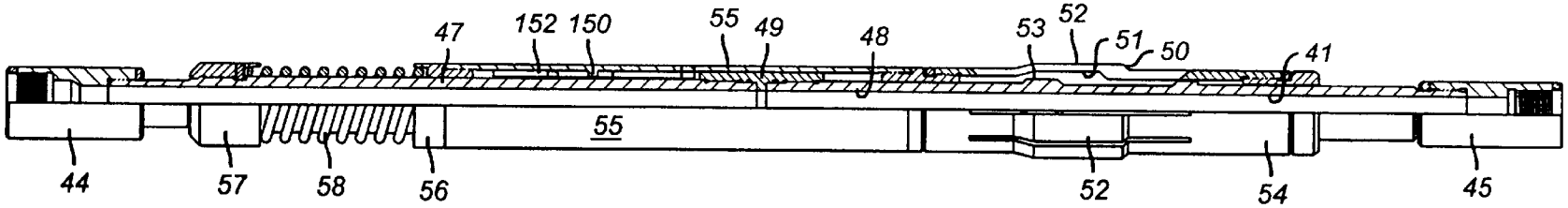
FIG. 6 is a quarter section view of the SMART collet.

With respect to FIG. 6, the SMART collet construction provides a continuous mandrel structure between a top sub 44 and a bottom sub 45 having a fluid flow bore 41 therethrough. An upper mandrel 47, is secured at one end to the top sub 44 and to a mandrel coupling 49 at the other end. The lower mandrel 48 is secured at one end to the bottom sub 45 and to the mandrel coupling 49 at the upper end. The mandrel upset profile 53 is a projection shoulder from the lower mandrel 48 surface.

The collet fingers 52 are longitudinal strip elements of a cylindrical collet housing 54 circumscribing the lower mandrel 48. The fingers 52 are integral with the housing wall at opposite longitudinal ends. However, the fingers 52 are circumferentially separated by longitudinal slots. The internal perimeter 51 of the fingers 52 is radially relieved to permit radial constriction of the finger shoulder 50 against the upset profile 53.

A cylindrical upper mandrel housing 55 is radially confined about the upper mandrel 47 by a spring retainer collar 56. A second spring retainer collar 57 secured to the upper mandrel 47 axially confines a coiled spring 58. The spring force bias against the upper mandrel housing is directed away from the mandrel collar 57. From the inside wall of the upper mandrel housing 55 is a radially projecting index pin 150. Within an annular space between the inside surface of the upper mandrel housing 55 and the outer surface of the upper mandrel 47 is an orientation sleeve 152. The orientation sleeve 152 is axially confined along the length of the upper mandrel 47 but freely rotatable thereabout. Around the outer cylindrical surface of the orientation sleeve 152 is a cylindrical, cam slot 154 that meshes with the index pin 150 whereby axial displacement of the mandrel housing and pin 150 drives the orientation sleeve 152 rotationally about the mandrel axis. However, the axial displacement limit of the cam slot 154, at a particular rotational position of the orientation sleeve, dictates the axial location of the entire mandrel housing and collet fingers 52 relative to the mandrel tubes 47, 48 and the mandrel upset profile 53.

Figure 7:
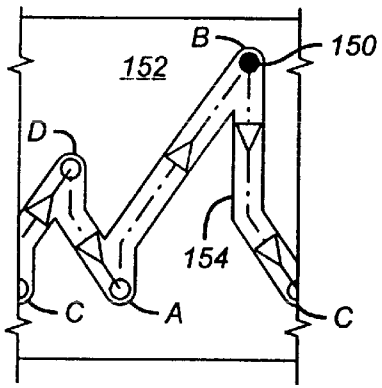
FIG. 7 is a planar developed view of the SMART collet orientation sleeve.

The direction of the orientation sleeve rotation is shown by the FIG. 7 planar development. This course includes four longitudinal set points A, B, C, and D for the index pin 150 around the sleeve circumference. Compressive force between the indicating collar shoulder 42 and the collet shoulder 50 drives the indexing pin 150 along the cam slot 154 to the upper limit points B and D. As the downhole string weight is lifted, the spring 58 drives the indexing pin 150 along the cam slot 154 to the lower limit points A and C. Each axial shift of the downhole string weight advances the orientation sleeve 152 rotatively about the upper mandrel 47.

The SMART collet 120 is automatically configured to alternately function as either a snap through locator or a positive locator of the service string 40. By observation of the downhole string weight fluctuation, the service string position is positively located at each of numerous predetermined depth positions along the wellbore by applying set-down weight against a particular indicating coupling. Moreover, the tool is always oriented to a retrieval mode.

Figure 8:
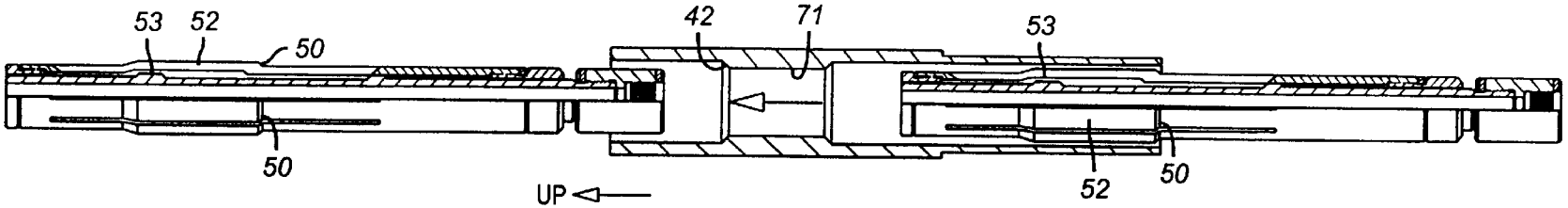
FIG. 8 is a quarter section view of the SMART collet pre-locate position.

The SMART collet is 120 is run into the well with the orientation sleeve 152 in the pre-locate position A. Here, the mandrel upset profile 53 is located within the internal perimeter 51 of the collet fingers 52 as illustrated by FIG. 8. The collet may-be picked up through the indicating couplings without changing the orientation sleeve 152 position.

Figure 9:
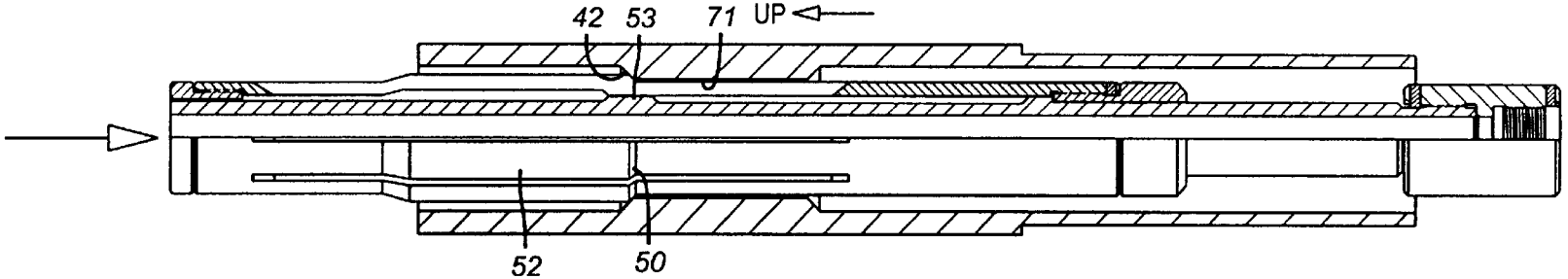
FIG. 9 is a quarter section view of the SMART collet locate position.

When the tool is moved downward, the indicating shoulder 50 on the collet engages the shoulder 42 in the desired indicating coupling 71 or 95, for example, as shown by FIG. 9. At about 700 lbs. of set-down weight, for example, the spring 58 is compressed as the mandrel housing 55 is moved upward by the force of the set-down weight against the spring bias. As the mandrel housing slides upward, the pin 150 in the mandrel housing tracks along the cam slot 154 from the pre-locate position A to the locate position B in the orientation sleeve 152. This allows the collet fingers 52 to be radially supported by the upset 53 on the lower mandrel. The fingers 52 cannot radially constrict to permit the finger shoulder 50 to pass the completion string shoulder 42 on the indicating coupling 71. Hence, the collet cannot be pushed through the indicating coupling thereby positively fixing the relative location of the SMART collet and the service string 40.

Figure 10:
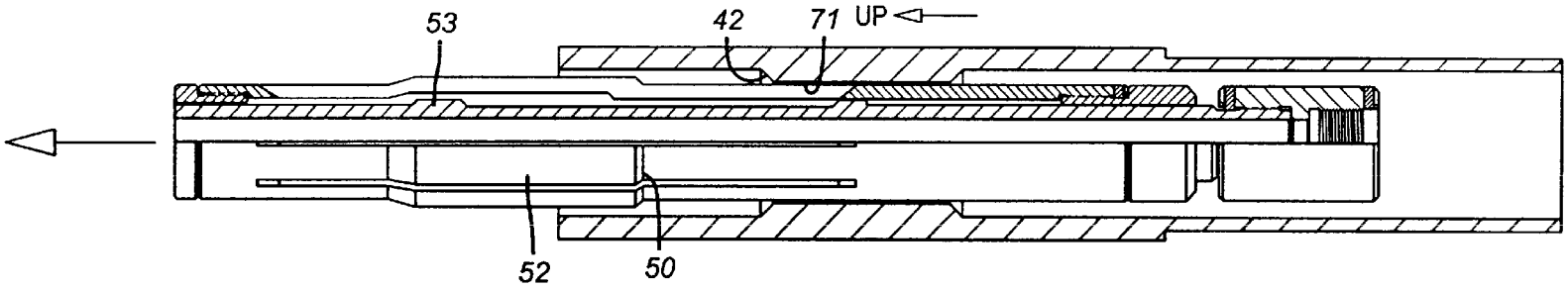
FIG. 10 is a quarter section view of the SMART collet pre-snap position.

When the compressive load on the collet shoulder 50 is removed by lifting the service string 40, the spring 58 pushes the mandrel housing 55 down and the pin 150 in the mandrel housing cam slot 154 advances from the locate position B to the pre-snap position C by rotation of the orientation sleeve 152 as shown by FIG. 10.

Figure 11:
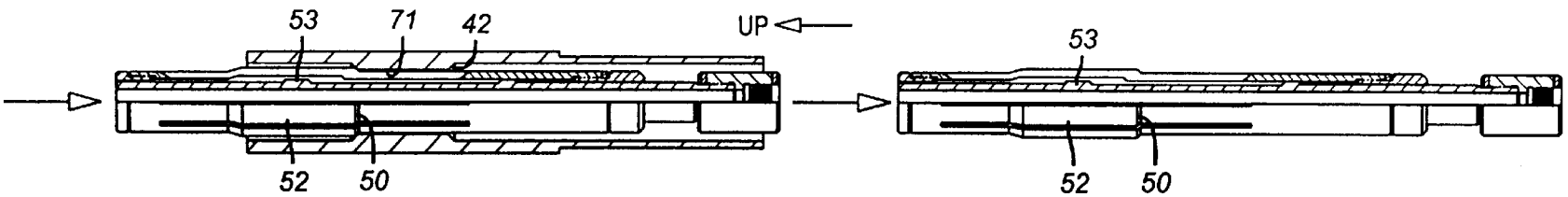
FIG. 11 is a quarter section view of the SMART collet snap position.

The tool may now be moved down again until the collet shoulder 50 engages the indicator coupling shoulder 42 again. At about 400 lbs. of set-down weight, for example, the spring 58 is compressed by upward axial movement of the mandrel housing 152 and the pin 150 tracts along the cam slot 154 from the pre-snap position C to the snap position D. At this position, the collet fingers 52 are not radially supported by the mandrel upset profile 53 and are free to flex radially inward. With about 5,500 lbs. of set-down weight, for example, the collet may be pushed past the indicating coupling shoulder 42 and lowered further along the wellbore as shown by FIG. 11.

When the collet snaps through the indicating coupling, the spring 58 will push the mandrel housing 55 down. This axial displacement of the mandrel housing 55 advances the pin 150 along the cam slot 154 back to the pre-locate position A to complete the cycle as illustrated by FIG. 8.

DESCRIPTION OF THE METHOD

An initial observation of the present completion method is to note that although the description herein is for only two independent production zones, those of ordinary skill will recognize that the steps described for the second zone may be repeated for as many zones as desired. There is, however, one point of possible distinction. The intermediate packer 37 of this description is a common pressure and fluid barrier between two completion zones 12 and 14. In the case of several completion zones that are separated by great distances, it may be more expedient to set upper and lower isolation packers for each of the several production zones.

As a first step in setting the completion string 30, a basement packer 39 is positioned, the slips 60 set and the annulus seal elements 62 engaged with the casing 16. The basement packer 39 becomes the benchmark from which the axial locations (along the borehole length) of all other elements in the well are measured. Consequently, the downhole setting position is very carefully determined and accurately located. While there are several basement packer setting procedures available to the art, wireline procedures are often the most accurate, fastest and least expensive.

The basement packer 39 provides a sealing seat for an interface plug on the lower end of the completion string 30. At the wellbore surface, the completion string 30 is coaxially secured to the service string 40 by the hydraulic release adapter collet 27. The adapter collet 27 is an upper end adapter element that is integral with the service string 40 assembly and serves to secure the service string 40 to the drill string 29 and to the completion string 30. Accordingly, the surface rig and draw works that support the drill string 29 also supports and manipulates the service string 40 and completion string 30 for initial well placement and engagement with the basement packer 39.

In the axial assembly of the completion string 30, the screens 64 and 90 are positioned relative to the basement packer 39 location for final setting opposite of or in close proximity with the respective casing perforations 20 and 22. The locations of all other elements in the assembly of the completion string 30 and the service string 40 are dependent on these controlling positions.

Upon engagement of the basement packer 39 seat by the downhole end of the completion string 30, a ball plug 137 (FIG. 4), is deposited in the drill string 29 bore at the well surface. This ball plug is allowed to descend by gravity toward the flow closing seat 138 in the service string 40. Final engagement of the ball 137 with the seat 138 may be driven by a pumped fluid flow. If pumped, the seat 138 engagement event is signified at the well surface by an abrupt pump pressure increase.

At this point in the procedure, the annulus packers 35 and 37 are set as well as additional slips to further secure the completion string 30 within the well casing 16. As an immediate consequence, two independent pressure zones are created along the annulus between the casing 16 and the completion string 30. The upper pressure zone is bounded by the upper packer 35 and the intermediate packer 37. The lower pressure zone is bounded by the intermediate packer 37 and the basement packer seal 62. This assumes a convenient vertical proximity between the upper and lower pressure zones 12 and 14 as will permit a common, intermediate packer. Otherwise, each pressure zone will be provided independent upper and lower isolation packers.

After all packers and slips are set, the drill string 29 is rotated sufficiently to release the adapter collet 27 from the completion string 30. Upon release, the service string 40 may be lifted and axially repositioned relative to the completion string 30 for the purpose of manipulating the several tools and appliances along the length of the completion string. The axial position of the service string is determined for each step in the process by the SMART collet 120 in operative cooperation with an appropriate indicator coupling 71 and 95.

The fluid flow orifices 75 are positioned within the lower annulus section between the basement packer 39 and the intermediate packer 37. Axial shifting of the sleeve 74 opens or closes the fluid flow orifices 75. The lower screen 64 is constructed with a sliding sleeve 66 for closing the screen opening between the casing annulus and the internal bore of the completion string 30. Usually, screen 64 is open and the orifices 75 closed when the completion string is placed downhole, however.

Figure 4:
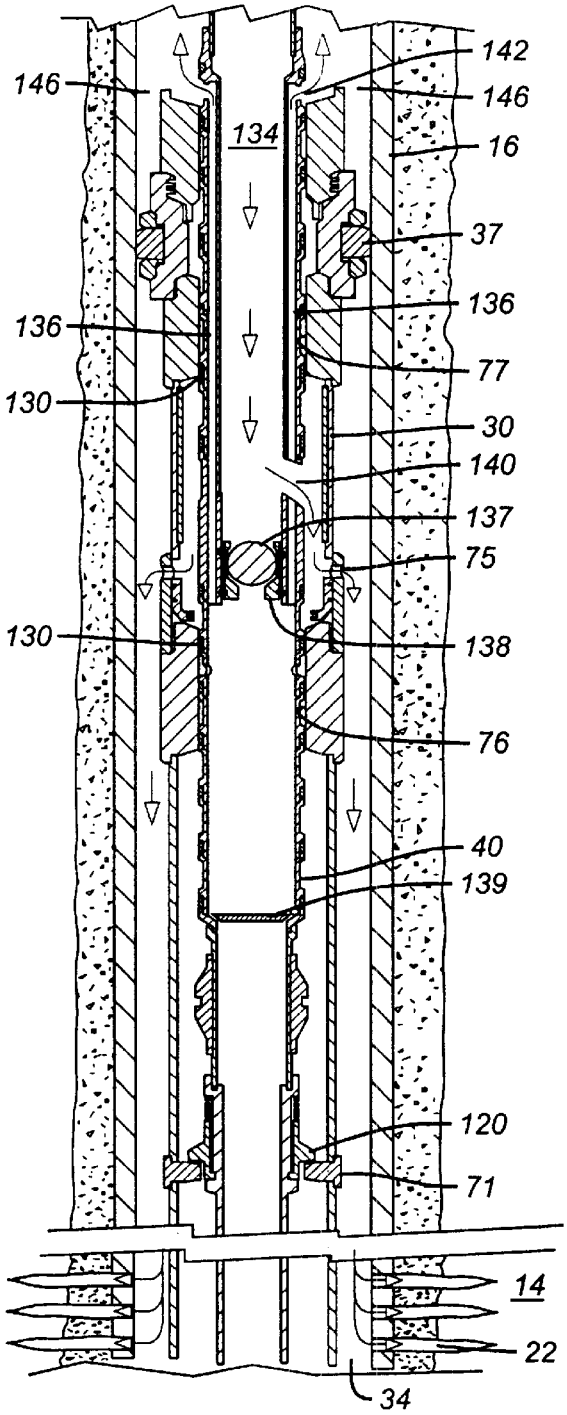
FIG. 4 is a schematic of the invention in the zone fracturing mode.

If the orifices 75 are closed when the completion string is placed downhole, the service string 40 is lifted to engage the sleeve 74 with the shifting tool 122 and open the fracture fluid flow orifices 75. Thereafter, the service string 40 is aligned to position the service string flow port 140 between the completion string seal bores 76 and 77 as illustrated by FIG. 4. Correspondingly, bonded seals 130 are positioned to engage the bore sealing surfaces 76 and 77 to isolate the inner annulus between the service string 40 outside surfaces and the completion string 30 inside surfaces. In this position, fracturing fluid is channeled from the service string internal flow section 134 through the flow ports 140 and through the fracture fluid flow orifices 75 into the outer annulus between the completion string 30 and the inner bore of the well casing 16. This annulus is confined axially along the well bore between the intermediate packer seals 37 and the basement packer seal 39. Accordingly, pump pressure against the fracturing fluid may therefore be dramatically increased to drive it through the casing 16 perforations 22 into the lower production zone 14 and into-the formation fractures 26.

As illustrated by FIG. 4, there is a highly restricted flow route along the lower bore of the service string 40 below the ball seat 138, above the orifice 140 and through the orifice 142 into the open annulus between the completion string 30 and service string 40. At the surface, the casing annulus is flow restricted to provide a fracturing pressure monitor source.

Formation fracturing fluid initially delivered to the production zone is usually a predominantly unmixed liquid to verify the fracturing model of penetration and distribution. Subsequently, the fluid is mixed with the desired aggregate material to form a slurry. The aggregate particles are accumulated between the upper and lower isolation packers as the gravel pack.

A gravel packing slurry is now pumped along the drill string bore, through the flow ports 140 and out through the flow orifices 75 into the outer annulus between the well casing and the completion string 30. The screen 64 separates the particulate constituency of the slurry from the fluid vehicle and permits the fluid vehicle to pass into the internal bore of the completion string 30 and from there, into the internal bore of the service string 40 below the plug seat 138. Return circulation of the fluid filtrate continues up the service string along the inner annulus 136, past the seal bore 77, out the flow ports 142 and back into the outer annulus between the completion string 30 internal bore and the service string 40. The gravel constituency of the slurry remains in the outer annulus of the well around the screen 64. Continuation of this circulation accumulates the lower gravel pack 34 within and along the outer annulus between the packer 39 and at least the completion string flow orifices 75.

Figure 5:
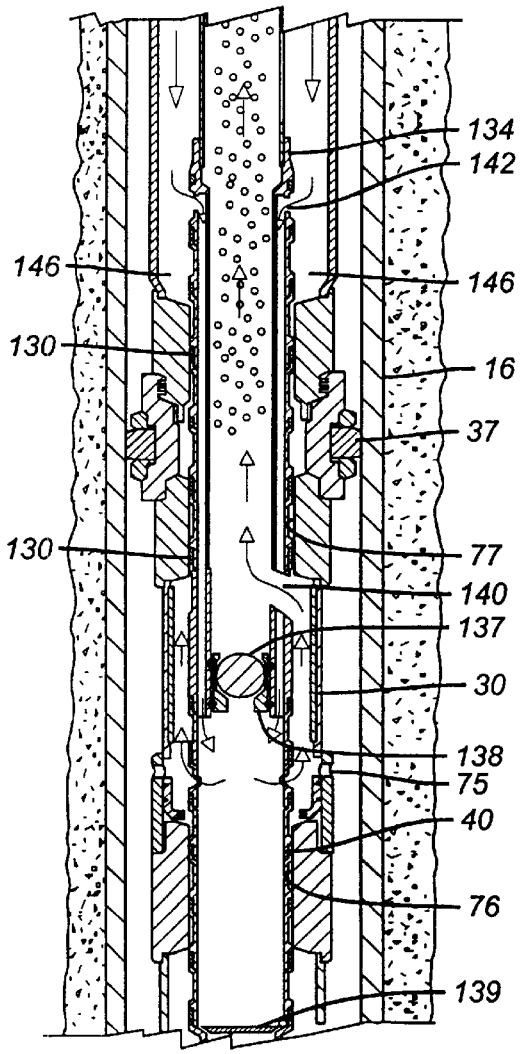
FIG. 5 is a schematic of the invention in the backwash mode.

When the gravel placement procedure is complete, it will next be necessary to flush the tubing of residual slurry that remains in the tubing bore. Flushing of the tubing bore is normally a reverse circulation process. The service tool is therefore indexed by a set-down engagement of the SMART collet 120 with the indicating coupling 71 to position the flow port 140 above the seal bore 77 as shown by FIG. 5. At this position, a flushing flow of working fluid may be pumped along a reverse flow circulation route that descends along the outer annulus 146 between the completion string and the service string. This reverse flow enters flow port 140 into the internal bore of the service string 40 to sweep residual packing particulates upwardly for removal from the service and tubing string bores.

Upon completion of the lower gravel pack 34, the drill string is raised to close the screen 64 flow area by shifting the closure sleeve 66 with the closing tool 110. Next, the drill string 29 is lifted to engage the shifting tool 122 with the orifice 75 closure sleeve 74 to close the orifice. The lower gravel pack zone 34 is now completely isolated between the basement packer 39 and the intermediate packer 37 from subsequent fluid pressure and flow events within the completion string 30 bore. Hence, fluid pressure and compositions necessary to fracture and gravel pack another production zone served by the same completion string 30 will not affect the previously completed lower zone 14. Of course, no formation fluids will enter the completion string 30 from the production zone 14 so long as the screen closure sleeve 66 and orifice closure sleeve 74 are closed. When all production zones within a given wellbore have been completed, the service string 40 will be returned to the lower position to open the sleeve 66.

To complete the next production zone 12, the service string 40 is lifted further along the completion string 30 to engage the screen flow control sleeve 92 by the shifting tool 122 and thereby open the production screen 90. Preferably, the screen flow control sleeve 92 is closed when the completion string is originally positioned. In any case, the control sleeve 92 must be positioned to open the screen 90. Additionally, the fluid flow orifices 99 must now be opened by displacement of the control sleeves 98.

The SMART collet 120 is now cycled to compressively engage the collet shoulder 50 against the indicator coupling 95. This relationship aligns the service string cross-over flow port 140 within a sealed annulus between the seal bores 82 and 104 and opposite of the open orifices 99. From this annulus, a gravel packing slurry is discharged through the flow ports 99 into the outer annulus between the completion string 30 and the well casing 16. This outer annulus is longitudinally confined between the upper packer 35 and the intermediate packer 37. Slurry carrier fluid penetrates the open screen 90 but the slurry particulates do not. Hence, the gravel packing 32 accumulates. As the gravel packing particulates accumulate, a portion of the fracture fluid is driven under high pressure through the casing perforations 20 into the production zone 12 to enlarge and expand the fractures 24.

Residual slurry carrier fluid stripped of particulates by the screen 90, enters the internal bore of the completion string to flow upwardly around the lower end of the service string 40 and enter the service string bore through the return flow ports 144. The inner annulus 136 carries the return flow past the seal bores 82 and 104. Discharge from the inner annulus 136 is through the flow ports 142 and into the outer annulus above the upper seal bore 104. Return circulation flow to the surface continues along the outer annulus between the drill string 29 and the well casing 16.

After the placement procedure for the upper gravel pack 32 has been completed, the service string 40 is again lifted and the SMART collet shoulder 50 is set down against the indicator coupling 95. This position aligns the cross-over ports 140 and 142 above the completion string upper seal bore 104. At this relative setting, a reverse flow of flushing fluid is pumped down the wellbore annulus between the casing 16 and drill string 29. This reverse flow enters the service string internal bore through the cross-over flow ports 140 and 142 and returns up the drill string 29. Up-flow of the fluid along the service string internal bore flushes residual gravel packing slurry from the service and drill string bores by return to the surface.

When the gravel pack placement procedure is completed, the sliding closure sleeves 98 for the orifices 99 and the sleeves 92 for the screen 90 are closed and the procedure described above is repeated for additional production formations to be produced within a common completion string.

Although my invention has been described in terms of specified embodiments which are set forth in detail, it should be understood that the description is for illustration only and that the invention is not necessarily limited thereto, since alternative embodiments and operating techniques will become apparent to those of ordinary skill in the art in view of the disclosure. Accordingly, modifications are contemplated which can be made without departing from the spirit of the described and claimed invention.

What is claimed is:

1. An apparatus for extracting fluids from a plurality of producing earth formations along a single wellbore comprising an elongated completion string, said completion string having:

a. a continuous internal bore opening along the length of said completion string;

b. upper and lower packers respective to each of said producing formations for isolating a respective annulus between said completion string and a wall of said wellbore;

c. respective to each producing formation, a flow orifice between said upper and lower packers, said flow orifice having a selectively displaced closure member;

d. respective to each producing formation, a flow screen between said upper and lower packers, said flow screen having a screen flow closure member; and, e. respective to each producing formation, a service string position indicator.

2. An apparatus as described by claim 1 wherein said completion string comprises at least two service string position indicators respective to each producing formation.

3. An apparatus as described by claim 1 wherein said screen flow closure members are selectively displaced by service string shifting tools.

4. An apparatus as described by claim 1 wherein said flow orifice closure members are selectively displaced by service string shifting tools.

5. An apparatus as described by claim 1 wherein said completion string includes internal bore sealing surfaces disposed within said internal bore opening above and below each of said flow orifices for cooperatively engaging service string sealing elements.

6. An apparatus as described by claim 1 further comprising a service string having an internal flow bore along the length thereof, a crossover flow tool within said service string having a flow obstructive plug seat in said internal flow bore and an inner flow annulus above said plug seat, a first flow port above said plug seat between said internal flow bore and an outer perimeter surrounding said crossover tool, a second flow port between said inner flow annulus and said outer perimeter and a third flow port below said plug seat between said internal flow bore and said outer perimeter.

7. An apparatus as described by claim 6 wherein said service string includes a selectively deployed set-down element for positively determining the relative axial alignment between said completion string and said service string.

8. An apparatus as described by claim 7 wherein said set-down element cooperates with the position indicator respective to said completion string.

9. An apparatus as described by claim 8 wherein said completion string includes at least two position indicators respective to each producing formation.

10. An apparatus as described by claim 7 wherein said set-down element comprises a collet shoulder for engaging said service string position indicator.

11. A method of completing a plurality of fluid producing zones within a single wellbore, said method comprising the steps of:

a. casing said wellbore along said production zones;

b. perforating a plurality of casing sections adjacent said production zones;

c. securing within said casing, a completion string having an internally continuous fluid flow bore and a surrounding annulus externally;

d. providing upper and lower packers around said completion string to isolate sections of said annulus corresponding to the perforated sections of said casing;

e. respective to each perforated section, providing a fluid flow orifice in said completion string between the internal bore of said completion string and said annulus;

f. respective to each perforated section, providing a production screen in said completion string between the internal bore of said completion string and said annulus;

g. respective to each perforated section, providing service string location surfaces at each of at least two alignment stations;

h. closing the fluid flow orifices and production screens respective to all but one of said perforated sections;

i. opening the fluid flow orifice and production screen respective to said one perforated section to pass a pressurized flow of formation fracturing fluid;

j. set-down positioning a crossover flow tool within said internal bore at a first alignment station adjacent said one perforated section to deliver a gravel slurry through the respective fluid flow orifice into said one annulus and returning slurry carrier fluid through the respective production screen and said crossover flow tool;

k. set-down positioning said cross-over flow tool at a second alignment station adjacent said one perforated section to flush said internal bore of residual gravel slurry above said crossover tool;

l. closing said one production screen and fluid flow orifice;

m. opening a second production screen and fluid low orifice respective to a second perforated section; and, n. repeating steps J through L in said second perforated section.

* * * * *